US007270327B1

(12) United States Patent
Hsu

(10) Patent No.: US 7,270,327 B1
(45) Date of Patent: Sep. 18, 2007

(54) GAME PLAYING DEVICE FOR ROLLING BALLS

(75) Inventor: Kun-Yu Hsu, Tainan (TW)

(73) Assignee: Shine Sport Facility Co., Ltd., Tainan (TW)

( * ) Notice: Subject to any disclaimer, the term of this patent is extended or adjusted under 35 U.S.C. 154(b) by 0 days.

(21) Appl. No.: 11/507,454

(22) Filed: Aug. 22, 2006

(51) Int. Cl.
*A63B 71/02* (2006.01)

(52) U.S. Cl. ..... 273/113; 273/109; 273/451; 273/459

(58) Field of Classification Search ..... 273/109, 273/113, 115, 116, 440, 459, 441, 453
See application file for complete search history.

(56) References Cited

U.S. PATENT DOCUMENTS 3,556,527 A * 1/1971 Margolis et al. ..... 273/115
3,617,061 A * 11/1971 Goldfarb et al. ..... 273/110
D418,894 S * 1/2000 Kuo ..... D21/811
6,129,635 A * 10/2000 Kuo ..... 472/49
6,554,277 B1 * 4/2003 Descamps et al. ..... 273/113
6,866,269 B2 * 3/2005 Liebau et al. ..... 273/441
2003/0080504 A1 * 5/2003 Liebau et al. ..... 273/109

* cited by examiner

*Primary Examiner*—Raleigh W. Chiu
(74) *Attorney, Agent, or Firm*—Rosenberg, Klein & Lee

(57) ABSTRACT

A game playing device for rolling balls includes a game surface, a plurality of bar-shape elements and at least one rolling ball that rolls on the game surface. The game surface is made of a fabric and has an area and a shape including a circular shape or a rectangular shape, and its edge has a holding portion provided for users to hold and lift, and both ends of the bar-shape element are fixing ends provided for users to freely attach and detach the bar-shape element on any position of the game surface, preferably by adhesive tapes. The bar-shape element is bent into an arc shape to simulate a goal or an obstacle when it is attached. The game surface can be placed on a floor or held by players for playing the game in different ways based on their creativity and imagination and adding more fin to the game.

9 Claims, 3 Drawing Sheets

GAME PLAYING DEVICE FOR ROLLING BALLS

BACKGROUND OF THE INVENTION

1. Field of the Invention

The present invention relates to a game playing device for rolling balls, and more particularly to a game playing device capable of freely attaching or detaching a bar-shape element on a game surface for rolling balls, and the bar-shape element can be used as an obstacle for rolling balls or a goal for shooting balls on a game surface set by players, and thus players can hold the game surface or place the game surface on a floor to play a game by a single player, double players, or a multiple of players, so as to provide diversified fun games.

2. Description of the Related Art

Computer games are recreations provided for relaxing our mood and releasing our pressure after work or school and training our learning skill or physical capacity as well as providing us lots of fun. Therefore, different game device or game manufacturers try their best to design various game equipments for players.

However, different game playing devices are restricted by many conditions, such as the playing field which could be set indoor or outdoor, depending on the weather conditions, or the number of players is limited to a single player or two players, and does not allow more people to play the game at the same time that can maximize the utility and functionality of the game playing devices. The game playing devices may be restricted by the rules and methods of playing the game and cannot be changed freely, and thus making the game inflexible or even monotonous.

Therefore, the inventor of the present invention based on years of experience in the related industry to conduct extensive researches and experiments, and finally developed and invented a ball game playing device structure, such that the games can be played without being limited by the field and rules. The method and mode of playing the game can be changed anytime based on the player's imagination and creativity to maintain the fun of the games.

SUMMARY OF THE INVENTION

Therefore, it is a primary objective of the present invention to provide a game playing device for rolling balls, and the device can be used indoor or outdoor, and applicable for single players, double players, and a multiple of players, and the device also can train the players' balance of hands, response of eyes, and physical fitness.

A secondary objective of the present invention is to provide a game playing device for rolling balls that can be placed on a floor to simulate a billiard game, a golf game or a croquet game.

Another objective of the present invention is to provide a game playing device for rolling balls that can freely arrange and install a bar-shape element on a game surface to serve as a goal or an obstacle for the game, so as to improve the fun of the game.

A further objective of the present invention is to provide a game playing device for rolling balls, whose game surface has a plurality of color blocks, and the bar-shape elements can be distinguished by different colors or numbers for a game played by a multiple of players.

To achieve the foregoing objectives, the game playing device for rolling balls in accordance with the invention comprises a game surface, a plurality of bar-shape elements and at least one rolling ball that rolls on the game surface. The game surface is made of a fabric and has a specific area and its edges are provided for users to hold and lift, and both ends of the bar-shape element are fixing ends provided for users to freely attach and detach the bar-shape element onto any position of the game surface. When the bar-shaped element is attached, the bar-shape element is bent into an arc shape.

The game playing device for rolling balls in accordance with the present invention further includes a plurality of color blocks on the game surface, and each bar-shape element may come with a different color or number for its distinction, or the bar-shape element has a woven net disposed on a side of the bar-shaped element to simulate a goal.

DETAILED DESCRIPTION OF THE PREFERRED EMBODIMENTS

Figure 1:
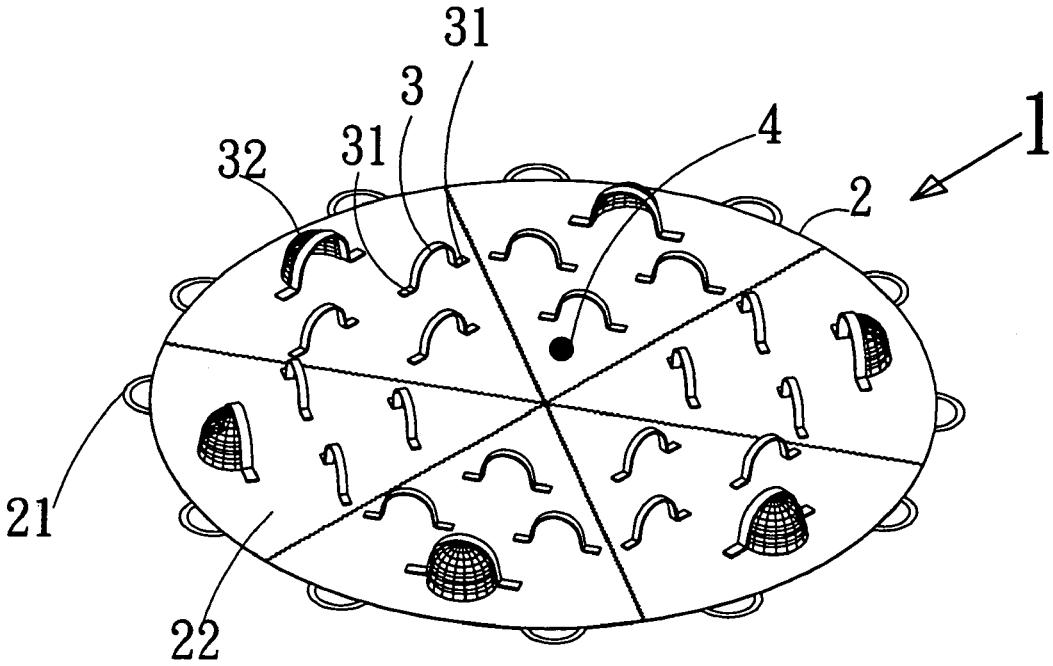
FIG. 1 is a schematic view of a first preferred embodiment of the present invention.
Figure 2:
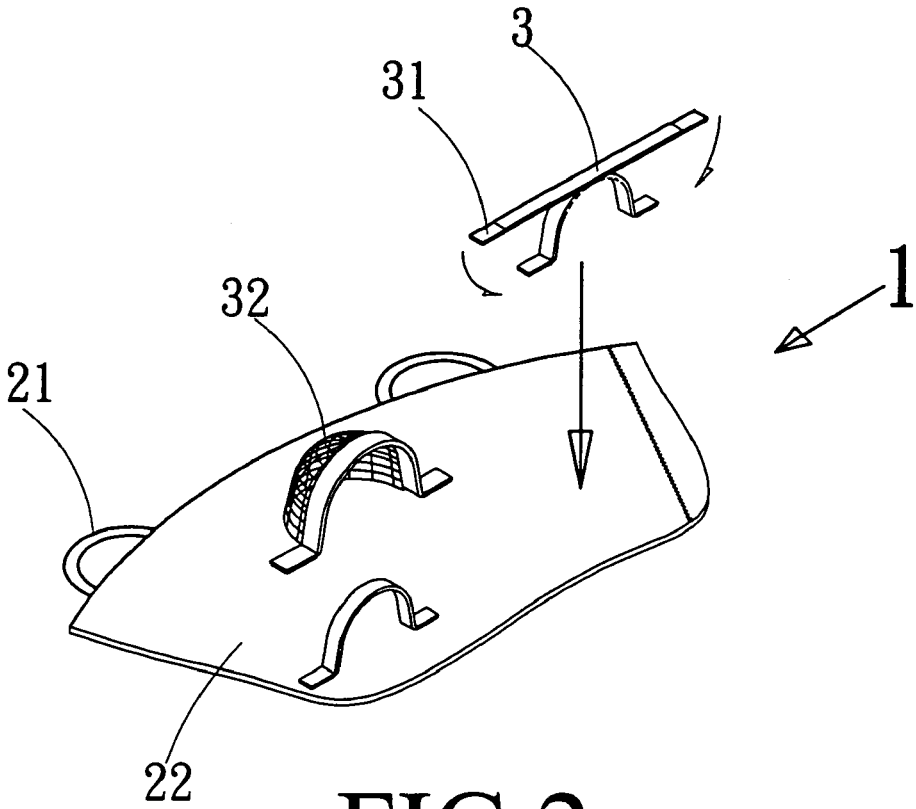
FIG. 2 is a top view of a first preferred embodiment of the present invention.

The technical contents, objectives and effects of the present invention will become apparent by the detail description together with the accompanying drawings as follows:

Referring to FIGS. 1 and 2 for a first preferred embodiment of a game playing device for rolling balls in accordance with the present invention, the game playing device 1 comprises a game surface 2, a plurality of bar-shape elements 3 and at least one rolling ball that rolls on the game surface 2. The game surface 2 is made of a fabric and has a specific area and a specific shape. The fabric could be a woven cloth, an unwoven cloth, a meshed cloth or any other cloth made of cotton materials, polymers or their mixtures. Particularly, the game surface 2 is lightweight and foldable, and thus it is suitable for users to hold, lift or swing the edges of the game surface 2.

In this embodiment, the game surface 2 has a specific area in a circular shape, and the edges of the game surface 2 have a plurality of holding portions 21 provided for users to hold and grab, and the holding portion 21 is in shape of a protruding ear, and two holding portions 21 are maintained with an appropriate distance apart from each other for facilitating users to hold by both hands. Further, the game surface 2 has a plurality of color blocks 22, and each color block 22 corresponds to two holding portions 21 for indicating the offensive and defensive zones for different players.

The bar-shape element 3 is in a bar shape and comes with a specific hardness for users to bend the bar-shape element 3, and both ends of the bar-shape element are fixing ends 31, so that players can freely attach and detach the fixing ends 31 on any position of the game surface 2. Preferably, the fixing ends 31 of the bar-shape element 3 can be fixed onto the game surface 2 by adhesive tapes. For example, the fixing end 31 has a plurality of densely distributed small protruding hooks, and the game surface 2 has fine hairs on its surface, so that the fixing ends 31 can be adhered and fixed onto the game surface 2, and also can be torn away easily from the game surface 2. The fixing end 31 can be adhered or removed repeatedly on any position of the game surface 2.

The bar-shape element 3 is bent into an arc shape for its use, so as to simulate an obstacle, and the bar-shape element 3 can have a woven net 32 disposed on a side of the bar-shape element 3 and selectively attached onto the game surface 2 to represent the position of a goal for shooting a rolling ball 4.

Figure 3:
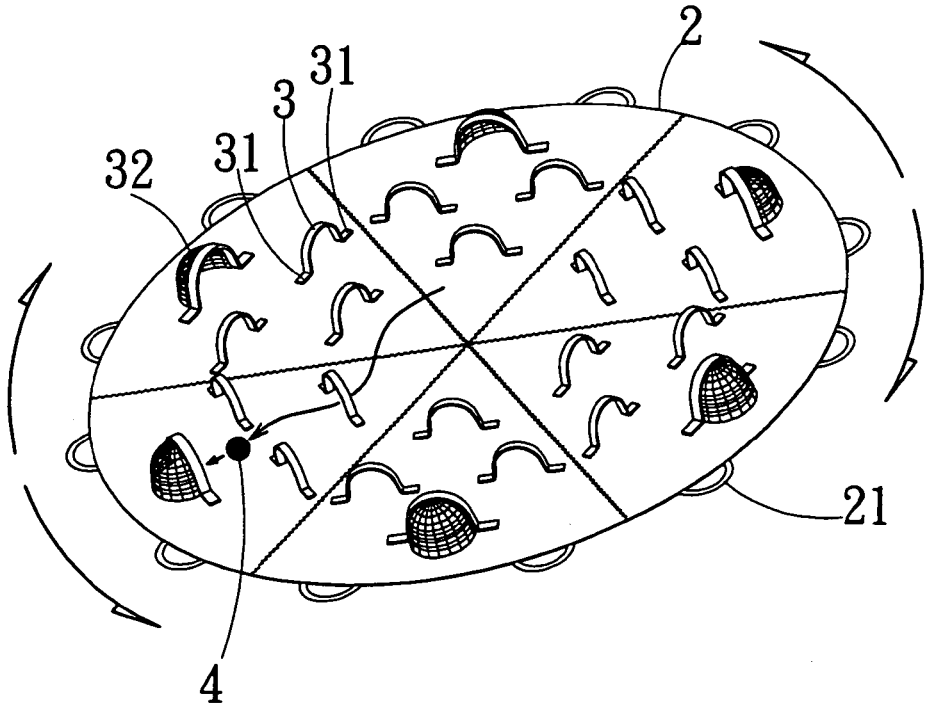
FIG. 3 is a top view of the operation of a first preferred embodiment of the present invention.

Referring to FIG. 3 for a preferred embodiment of the present invention, each player can freely fix the bar-shape element 3 onto the player's dedicated color block 22 and the bar-shape element 3 acts as an obstacle or a goal, and then the players hold the holding portion 21 by hands to lift the game surface 2 and try to roll the rolling ball 4. After the game starts, each player can swing the game surface 2 and try to avoid the obstacle and roll the rolling ball 4 into a goal simulated by the bar-shape element 3 having a woven net 32 as a basis for scoring points.

Both sides of the game surface 2 further include a bar-shape element 3 having a woven net 32, and the players are divided into two teams to defend each side, so as to simulate a soccer game. Therefore, the rules or methods of playing the game can be made upon the agreements of both parties, and thus the invention provides various kinds of game and gives more fun to the games.

In addition to the mode as described in the foregoing embodiment, the holding portion 21 of the game surface 2 may be a through hole (not shown in the figure) and the through holes can be disposed along the edges of the game surface 2 and provided for users to grab the edges by passing their hands through the through holes. Further, the fixing end 31 and the game surface 2 can be fixed by tying strings, buttons or any other appropriate fixtures. Further, the bar-shape elements 3 may come with different colors, numbers or texts for their distinction, and thus the holding portion 21 and the bar-shape element 3 can be modified or changed by persons skilled in the art, and they are not limited to those illustrated in the embodiments.

Figure 4:
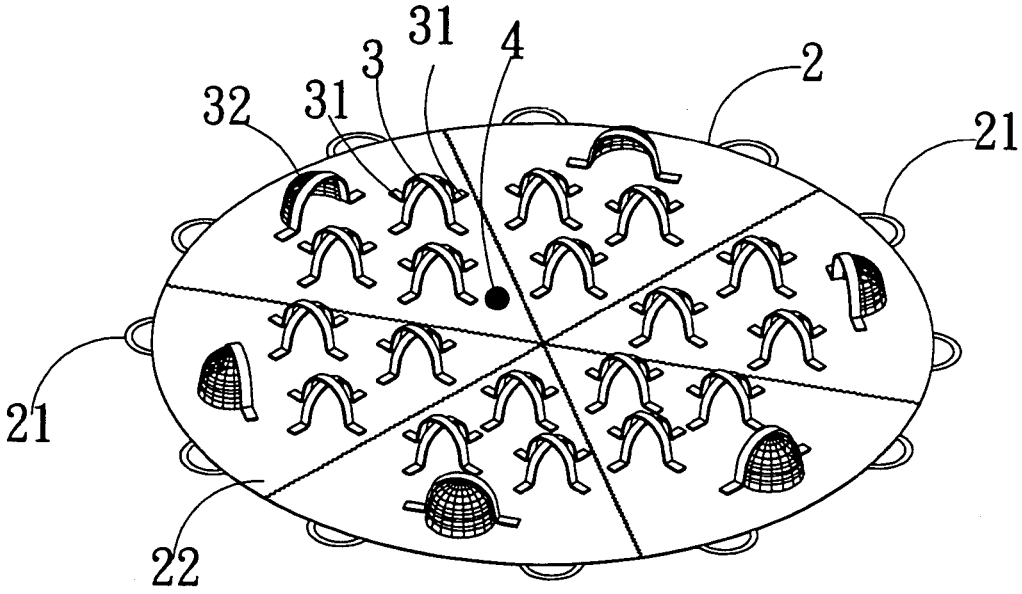
FIG. 4 is a top view of the operation of a second preferred embodiment of the present invention.

Referring to FIG. 4 for a second preferred embodiment of the present invention, the bar-shape element can be installed linearly, or two bar-shape element 3 can be intersected to form a cross shape and fixed onto the game surface 2 to increase the level of difficulty for avoiding obstacles.

Figure 5:
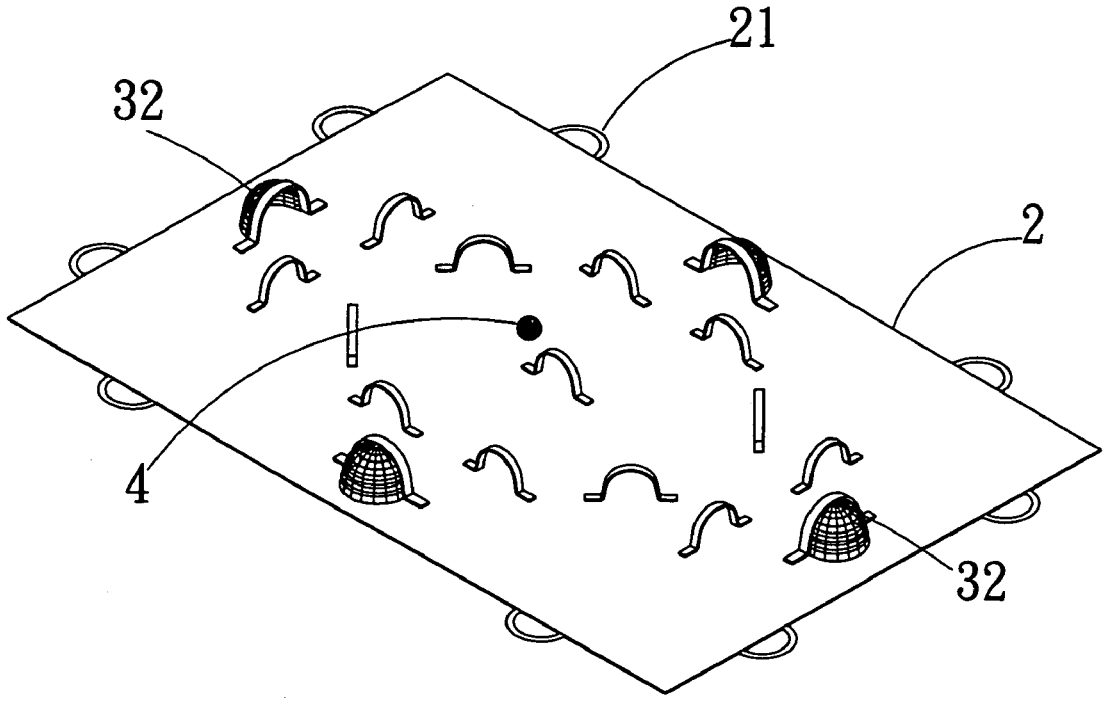
FIG. 5 is a top view of the operation of a third preferred embodiment of the present invention.

Referring to FIG. 5 for a third preferred embodiment of the present invention, the game surface 2 has a specific area in a rectangular shape. If four players are playing the game, the bar-shape elements 3 having a woven net 32 are attached onto the edges of the game surface proximate to each player, but there is no bar-shape element 3 having a woven net at any other place. Similarly, users can hold the holding portion 21 to lift and swing the game surface 2 to play the game, or the rectangular game surface 2 can be provided for two players to hold each side of the game surface 2 for a game played by two players.

Figure 6:
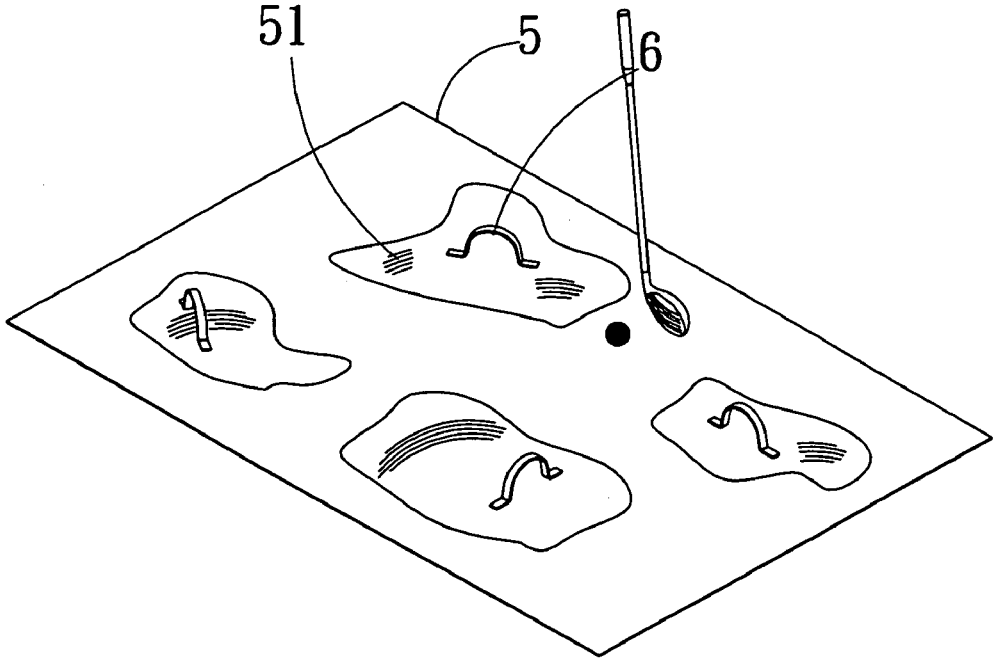
FIG. 6 is a top view of the operation of a fourth preferred embodiment of the present invention.

Referring to FIG. 6 for a fourth preferred embodiment of the present invention, the game surface 5 has a golf green pattern 51 for simulating a golf court, and a plurality of bar-shape elements 6 are bent in an arc shape to simulate golf holes and fixed onto the game surface 5. The game surface 5 can be placed on a floor to act as a golf trainer for users. Further, the game surface 5 can be simulated as a croquet court and provided for practicing personal striking skills.

In summation of the description above, the present invention provides a game surface with its edges held by one player, two players, four players or a multiple of players, so that the players can control the rolling ball by both hands to train their balance of hands and response of their brains. The methods and rules of playing the games can be changed flexibly, and thus the invention can provide extensive and flexible applications. Therefore, the present invention has the following advantages:

1. The invention can be used indoors or outdoors and played by one, two or more players, without being restricted by the field or the number of players. The bar-shape element can be used flexibly based on players' creativity and imagination to improve the fun of the games.

2. The invention can have different patterns such as the patterns simulating a golf game, a croquet game or a billiard game printed on both sides of the game surface, so that a game surface provides two different games and improves its using performance.

3. The structure of the invention is simple and easy to manufacture, and thus the cost can be very low to create high profits and values.

Only some embodiments of the present invention have been illustrated in the drawings, but it should be pointed out that many other modifications are conceivable within the scope of the following claims.

In summation of the above description, the present invention enhances the performance over the prior art. The invention further complies with the patent application requirements and is duly filed for the patent application.

What is claimed is:

1. A game playing device for rolling balls, comprising:

a game surface, made of a fabric and having a specific area and a specific shape, and its edge being provided for users to hold or lift;

a plurality of bar-shape elements, each having two ends as fixing ends provided for users to freely attach or detach said bar-shaped element at any position on said game surface, and said bar-shape element can be bent into an arc shape when said bar-shaped element is attached; and at least one rolling ball, being rolled on said game surface.

2. The game playing device for rolling balls of claim 1, wherein said game surface has a plurality of holding portions disposed at edges of said game surface and provided for users to hold.

3. The game playing device for rolling balls of claim 2, wherein said holding portion holding portion is in the shape of a protruding ear.

4. The game playing device for rolling balls of claim 2, wherein said holding portion is a through hole.

5. The game playing device for rolling balls of claim 1, wherein said game surface has a plurality of color blocks.

6. The game playing device for rolling balls of claim 1, wherein said bar-shape element has a woven net disposed on a side of said bar-shaped element.

7. The game playing device for rolling balls of claim 1, wherein said bar-shape element has a fixing end fixed to said game surface by an adhesive tape.

8. The game playing device for rolling balls of claim 1, wherein said bar-shape element comes with different colors for distinguishing said bar-shape element.

9. The game playing device for rolling balls of claim 1, wherein said bar-shape element comes with a number for distinguishing said bar-shape element.

* * * * *